US009506256B2

(12) United States Patent
Thiers

(10) Patent No.: US 9,506,256 B2
(45) Date of Patent: Nov. 29, 2016

(54) FLOOR COVERING, FLOOR PANELS AND METHOD FOR MANUFACTURING FLOOR PANELS

(71) Applicant: FLOORING INDUSTRIES LIMITED, SARL, Bertrange (LU)

(72) Inventor: Bernard Thiers, Eine (BE)

(73) Assignee: FLOORING INDUSTRIES LIMITED, SARL, Bertrange (LU)

( * ) Notice: Subject to any disclaimer, the term of this patent is extended or adjusted under 35 U.S.C. 154(b) by 0 days.

(21) Appl. No.: 14/926,139

(22) Filed: Oct. 29, 2015

(65) Prior Publication Data

US 2016/0046144 A1 Feb. 18, 2016

Related U.S. Application Data

(63) Continuation of application No. 13/937,811, filed on Jul. 9, 2013, now Pat. No. 9,194,133, which is a continuation of application No. 12/084,641, filed as application No. PCT/IB2006/003213 on Nov. 6, 2006, now abandoned.

(30) Foreign Application Priority Data

Nov. 9, 2005 (BE) ..... 2005/0542
Dec. 22, 2005 (BE) ..... 2005/0615

(51) Int. Cl.
*E04F 15/02* (2006.01)
*B44C 5/04* (2006.01)
(Continued)

(52) U.S. Cl.
CPC ..... *E04F 15/02033* (2013.01); *B44C 5/04* (2013.01); *B44F 9/02* (2013.01);
(Continued)

(58) Field of Classification Search
CPC ..... B44C 5/04; B44F 9/02; E04F 15/02; E04F 15/02033; E04F 15/04; E04F 2201/0115; E04F 15/02038; E04F 15/02161
See application file for complete search history.

(56) References Cited

U.S. PATENT DOCUMENTS 6,006,486 A 12/1999 Moriau et al.
6,234,299 B1 5/2001 Voorhees et al.
(Continued)

FOREIGN PATENT DOCUMENTS

DE 202 05 318 U1 6/2002
DE 102 56 501 A1 7/2004
(Continued)

OTHER PUBLICATIONS

International Search Report from International PCT Application No. PCT/IB2006/003213, Aug. 16, 2007.

*Primary Examiner* — Andrew J Triggs
(74) *Attorney, Agent, or Firm* — Workman Nydegger

(57) ABSTRACT

A floor covering is composed of a plurality of hard floor panels wherein the floor panels show a common general decor and may differ from each other in respect to their appearance and/or on their own have zones of a differing appearance. The floor panels, at least at two opposite sides or edges thereof, are provided with coupling parts allowing that two of such floor panels can cooperate with each other at these sides. At least some of the floor panels possess at least one chamfer, such as a beveled edge or the like, wherein the surfaces of these chamfers are provided, at least partially, with a separately applied decorative covering including at least a decorative layer. The appearance of the decorative covering is realized in a manner varying in function of differences occurring in the decor of the floor covering.

34 Claims, 11 Drawing Sheets

(51) Int. Cl.
*B44F 9/02* (2006.01)
*E04F 15/04* (2006.01)

(52) U.S. Cl.
CPC ..... *E04F 15/02* (2013.01); *E04F 15/02038* (2013.01); *E04F 15/02161* (2013.01); *E04F 15/04* (2013.01); *E04F 2201/0107* (2013.01); *E04F 2201/0115* (2013.01); *E04F 2201/026* (2013.01); *Y10T 29/49629* (2015.01)

(56) References Cited

U.S. PATENT DOCUMENTS 6,465,046 B1 10/2002 Hansson et al.
6,584,739 B2 7/2003 Zeif
6,585,369 B1 7/2003 Sievert et al.
6,617,009 B1 9/2003 Chen et al.
6,675,545 B2 1/2004 Chen et al.
6,761,008 B2 7/2004 Chen et al.
6,761,794 B2 7/2004 Mott et al.
6,786,019 B2 9/2004 Thiers
6,931,811 B2 8/2005 Thiers
6,933,043 B1 8/2005 Son et al.
6,986,934 B2 1/2006 Chen et al.
7,001,016 B2 2/2006 Baxter et al.
7,169,460 B1 1/2007 Chen et al.
7,211,310 B2 5/2007 Chen et al
7,249,445 B2 7/2007 Thiers
7,357,168 B2 4/2008 Mitsam
7,506,481 B2 3/2009 Grafenauer
7,556,690 B2 7/2009 Goto
7,632,561 B2 12/2009 Thiers
7,678,425 B2 3/2010 Oldorff
7,849,655 B2 12/2010 Chen et al.
7,861,753 B2 1/2011 Walker
7,918,062 B2 4/2011 Chen
7,964,133 B2 6/2011 Cappelle et al.
8,153,234 B2 * 4/2012 Nollet ..... B44B 5/026 428/141
8,161,701 B2 4/2012 Cappelle et al.
8,176,698 B2 5/2012 Lewark
9,194,133 B2 * 11/2015 Thiers ..... B44C 5/04
2001/0021431 A1 9/2001 Chen et al.
2001/0049010 A1 12/2001 Fenzi
2002/0014047 A1 * 2/2002 Thiers ..... B44C 1/24 52/313
2002/0031646 A1 3/2002 Chen et al.
2002/0056245 A1 5/2002 Thiers
2002/0142135 A1 10/2002 Chen et al.
2003/0012933 A1 1/2003 Senzani
2003/0033777 A1 2/2003 Thiers et al.
2003/0159385 A1 8/2003 Thiers
2003/0203165 A1 10/2003 Nobles et al.
2003/0207083 A1 11/2003 Hansson et al.
2004/0076788 A1 4/2004 Steinhardt et al.
2004/0086678 A1 5/2004 Chen et al.
2004/0219339 A1 11/2004 Dempsey et al.
2004/0255541 A1 12/2004 Thiers et al.
2004/0264992 A1 12/2004 Shiraishi
2005/0016099 A1 1/2005 Thiers
2005/0025934 A1 2/2005 Thiers
2005/0069681 A1 3/2005 Wright, Jr. et al.
2005/0076598 A1 * 4/2005 Lewark ..... E04F 15/02 52/591.4
2005/0167027 A1 8/2005 Lane
2005/0235593 A1 10/2005 Hecht
2005/0248649 A1 11/2005 Farrell et al.
2005/0249923 A1 11/2005 Reichwein et al.
2005/0249924 A1 11/2005 Reichwein et al.
2006/0032175 A1 2/2006 Chen et al.
2006/0059821 A1 3/2006 Coghlan et al.
2006/0130421 A1 * 6/2006 Nollet ..... B44B 5/026 52/582.1
2006/0156672 A1 7/2006 Laurent et al.
2006/0162271 A1 7/2006 Eisermann
2006/0179773 A1 8/2006 Pervan
2006/0179774 A1 8/2006 Thiers
2006/0179775 A1 8/2006 Thiers
2006/0179776 A1 8/2006 Thiers
2006/0234017 A1 10/2006 Tajima et al.
2008/0034701 A1 2/2008 Pervan
2009/0031662 A1 2/2009 Chen et al.
2009/0038256 A1 2/2009 Thiers
2009/0049792 A1 2/2009 Cappelle et al.
2009/0075037 A1 3/2009 Garitano
2009/0139170 A1 * 6/2009 Thiers ..... B44C 5/04 52/309.1
2009/0159156 A1 6/2009 Walker
2009/0260313 A1 10/2009 Segaert
2009/0260748 A1 10/2009 Cappelle et al.
2009/0305008 A1 12/2009 Nichols et al.
2011/0120634 A1 5/2011 Thiers et al.
2011/0200750 A1 8/2011 Meersseman et al.
2011/0219716 A1 9/2011 Chen
2013/0305649 A1 * 11/2013 Thiers ..... B44C 5/04 52/588.1

FOREIGN PATENT DOCUMENTS

EP 1 108 529 A2 6/2001
EP 1 382 773 A1 1/2004
EP 1 642 751 A2 4/2006
JP 557-185110 A 11/1982
JP 2001-293838 A 10/2001
JP 2004-060241 A 2/2004
WO 01/48333 A1 7/2001
WO 01/96688 A1 12/2001
WO 03/086779 A2 10/2003
WO 2004/042168 A1 5/2004
WO 2004/108436 A2 12/2004
WO 2006/003530 A2 1/2006
WO 2006/103565 A2 10/2006
WO 2007/054812 A2 5/2007

* cited by examiner

FLOOR COVERING, FLOOR PANELS AND METHOD FOR MANUFACTURING FLOOR PANELS

BACKGROUND

This invention relates to a floor covering, to floor panels for realizing such floor covering, as well as to a method for manufacturing floor panels.

According to a first aspect, the invention relates to the type of floor covering that is composed of a plurality of hard floor panels, wherein, on the one hand, the floor panels show a common general decor, however, on the other hand, among the floor panels showing the common general decor, also floor panels are present that differ from each other in respect to their appearance and/or as such have zones of a differing appearance, wherein these floor panels, at least at two opposite sides or edges thereof, are provided with coupling parts allowing that two of such floor panels can cooperate with each other at these sides, and wherein at least some of the floor panels possess at least one chamfer, such as a beveled edge or the like, wherein the surfaces of these chamfers are provided, at least partially, with a separately applied decorative covering consisting at least of a decorative layer.

Such type of floor covering is known as such. Herein, the general decor mostly is a wood decor or a stone decor. Mostly, this general decor is formed of several floor panels having a different appearance. So, for example, a floor covering representing an oak plank floor as a general decor, mostly will possess different floor panels representing planks of a different tint or degree of darkness. Also, the color, tint or the like often will vary considerably within the surface of one and the same floor panel.

Also, the application of a chamfer, which is provided with a separately applied decorative covering consisting at least of a decorative layer, is known. According to known embodiments, the decorative layer may consist of a print, for example, by means of transfer printing, or a coloration by means of a color, such as a lacquer or the like. Examples thereof are known, amongst others, from the patent documents WO 01/96688, WO 2004/108436 and US 2005/0076598. From these documents, it is also known to adapt the appearance of the decorative layer on the chamfer to the appearance of the upper side of the floor panels. The technique, known up to now, for realizing such "adaptation" consists in that a so-called global matching is performed and thereby one well-defined fixed appearance for the covering of the chamfer is determined, thus, of a well-defined color and/or with a well-defined fixed pattern, which globally fits best to all floor panels of one and the same global decor. When imitating a wooden plank floor with darker and lighter planks, the chamfers then are provided, for example, with a covering of one and the same color, which, for example, is situated in respect to its tint between the tints of the darker and light planks, by means of which thus a "global adaptation" is performed.

SUMMARY

However, the present invention aims at a more optimized adaptation of the decorative layer on the chamfer to the decor situated at the upper side of the floor panels. By such optimized adaptation, a technical solution is intended for performing better imitations of, for example, wooden floors, ceramic floor tiles and the like.

To this aim, the present invention relates to a floor covering of the aforementioned type, with the characteristic that the appearance of said decorative covering is realized in a manner varying in function of differences occurring in said decor of the floor covering. In other words, this means that the appearance of the covering present on the chamfer is not only adapted to the global appearance of the global decor, however, also more or less is separately adapted to certain differences occurring in the decor, and that the appearance of this covering thus varies in one and the same floor covering. In still other words, this means that the coverings on the chamfers, in respect to color and/or pattern, so to speak, are performed "in register" with the adjacent upper side of the floor panels at which they are provided.

It is clear that in this manner, a better imitation of, for example, real wooden floors is obtained and disturbing effects can be excluded.

The invention is primarily intended for application in the manufacture of laminate floor panels, more particularly DPL (Direct Pressure Laminate), the structure of which is generally known. Hereby, the pressing, sawing and the application of coupling parts at the edges of the floor panels form techniques applied herein that as such are generally known.

According to a number of preferred forms of embodiment, the invention also aims at coverings, which, on the one hand, meet the main idea of the invention, however, on the other hand, can be practically realized in mass production and moreover are of a good quality.

According to a preferred form of embodiment, the floor covering is characterized in that the appearance of said decorative covering is performed in a varying manner, at least in that for two or more panels, the decor of which is varying per panel, also a differing covering is provided on the chamfer present at these panels, respectively, wherein the covering of such chamfer then each time is adapted to the decor of the panel at which the respective chamfer is situated. A global adaptation per panel can be realized quite smoothly, as it is not necessary to take into account detail alterations in the surface of the panel itself.

According to another preferred form of embodiment, the floor covering is characterized in that the appearance of said decorative covering is performed varying for at least some of the floor panels by performing this appearance within the chamfer of one and the same panel in a varying manner, wherein the decorative covering of such chamfer then is adapted to alterations occurring in the decor of the respective panel itself.

According to a preferred form of embodiment, the floor covering is characterized in that the appearance of the decorative covering that is present on the chamfers is made varying by having at least the global color or tint thereof vary.

According to another possibility, the decorative covering applied on the chamfers is provided with a pattern, and the appearance of this covering is made in a varying manner by letting this pattern vary in a manner adapted to alterations that occur in the decor of the floor covering.

Preferably, the decorative layer substantially consists of a print. More particularly, it is preferred that this is a print that is implemented by means of a printer, more particularly by means of an inkjet printer or inkjet supply system.

Practically, it is preferred that the decorative layer is formed by a multicolor print.

Such prints offer the advantage that they allow a smooth realization of the aforementioned variations.

According to a particular form of embodiment, the aforementioned decorative covering comprises at least one transparent, or at least an at least partially transparent, covering layer that is provided on top of the decorative layer. Preferably, the covering layer is formed of a transparent or at least partially transparent substance that is applied by means of transfer printing. Such covering layer offers various advantages, such as a protection of the decorative layer.

According to a preferred form of embodiment, the covering layer shall give one or more of the following properties to the covering:

a. that the covering is dirt-repellent and/or dust-repellent;
b. that the covering is mildew-repellent;
c. that the covering has sealing properties, more particularly against water penetration, which can both be useful for preventing the absorption of water in the substrate and protecting the decorative layer, if this latter should be made of a material that is not waterproof;
d. that the covering provides for a smooth surface;
e. that the covering provides for a desired gloss degree, whether or not varying along the chamfer;
f. that the covering is maintenance-friendly;
g. that the covering is light-fast or, thus, UV-resistant;
h. that the covering is antistatic;
i. that the covering shows a surface structure.

It is noted that by the aforementioned "chamfers", chamfers are meant that are situated at an exterior edge of the respective floor panels, as well as chamfers can be meant that are made as imitation chamfers consisting of groove-shaped sunk portions situated in the top surface of the respective floor panels.

It is clear that the invention also relates to floor panels for forming the aforementioned floor covering made in accordance with the invention.

Apart from this, the invention also relates to a method for manufacturing the floor panels according to the invention in an efficient manner.

To this aim, the present invention relates to a method for manufacturing floor panels, more particularly floor panels for forming the aforementioned floor covering, wherein such floor panels, at least at two opposite sides or edges, are provided with coupling parts allowing that two of such floor panels can cooperate with each other at these sides, and wherein the respective floor panels are provided with at least one chamfer, such as a beveled edge or the like, wherein the surface of said chamfer is provided, at least partially, with a covering, with as a characteristic that said covering is formed at least of a decorative layer, which is provided on the surface of the chamfer by means of a controllable application system, wherein, by means of controlling said application system, at least the appearance of the covering thus formed is altered, such that the appearance of the obtained decorative covering varies in function of differences occurring in the aforementioned decor of the floor covering.

According to a preferred form of embodiment of this method, it is characterized in that the covering of such chamfer is performed, globally seen, uniformly per panel or at least per chamfer, however, in such a manner that, for certain differing floor panels, it is globally adapted to the decor of the floor panel at which said covering is situated.

According to another preferred form of embodiment, the method is characterized in that the covering of such chamfer is performed such that the appearance thereof alters in the panel itself.

Preferably, the control of the application system takes place in function of a detection performed at a respective floor panel. By means of such detections, the coverings, which vary in their appearance, can smoothly be produced in line, wherein automatically, by means of a suitable control, the covering is obtained that is desired according to the invention.

In a practical form of embodiment, the control is realized by means of a forward coupling, wherein a detection is performed on the top surface of the floor panel, in order to thereby determine features in relation to the appearance thereof, after which these data are used to realize an adapted covering on the respective chamfer.

Preferably, for the application system a digitally controllable application system is used, for example, a digital printer, more particularly a printer working according to the inkjet principle.

Also, it is preferred that for the application system, use is made of a multicolor printing system, more particularly a multicolor printer, wherein by the control thereof the global color or tint of the covering, as aforementioned, is performed in a varying manner.

In a particular form of embodiment, use is made of a printing system with which the decorative layer is performed with a pattern, and the printing system is controlled such that the obtained pattern varies in function of the pattern at the upper side of the respective floor panel.

A number of further independent aspects of the invention will become apparent from the further description and claims.

BRIEF DESCRIPTION OF THE DRAWINGS

With the intention of better showing the characteristics of the invention, hereafter, as an example without any limitative character, several preferred forms of embodiment are described, with reference to the accompanying drawings, wherein.

DETAILED DESCRIPTION OF VARIOUS EMBODIMENTS

Figure 1:
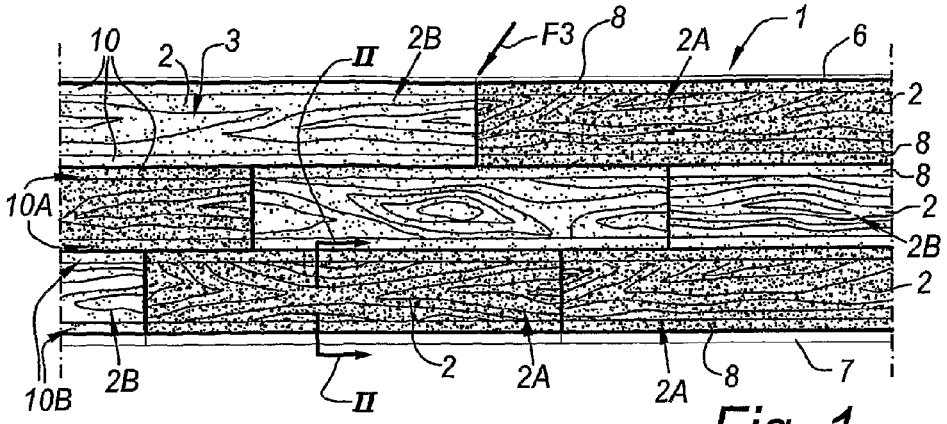
FIG. 1 schematically represents a floor covering according to the invention.

As schematically represented in FIG. 1, the invention relates to a floor covering 1 that is composed of several hard floor panels 2 representing a common general decor 3. In the represented example, this common decor consists of a wood decor. Other decors or patterns, for example, a stone decor, are not excluded. Amongst the floor panels 2 representing the common general decor 3, floor panels are present which, in respect to their appearance, differ from each other at least in certain respects. In the represented example, the difference consists in that certain floor panels are darker than others. The darker floor panels are specifically indicated by reference 2A, whereas the other, lighter-colored, floor panels are indicated by 2B.

Figure 2:
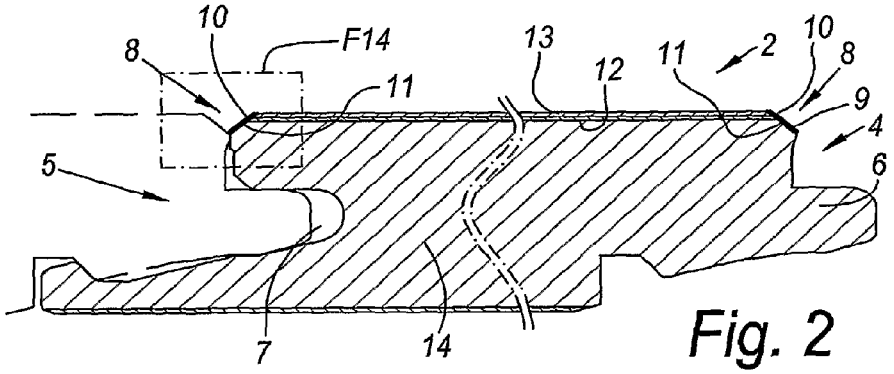
FIG. 2, at a larger scale, represents a cross-section according to line II-II in FIG. 1.

As represented in greater detail in FIG. 2, the floor panels 2, at least at two opposite sides or edges 4-5, are provided with coupling parts 6-7, which allow that two of such floor panels 2 can cooperate with each other. Further, the floor panels 2 comprise at least one, however, in this case, two chamfers 8, such as a beveled edge or the like, the surfaces 9 of which are provided, at least partially, with a separately applied decorative covering 10 consisting at least of a decorative layer 11.

For clarity's sake, in FIG. 1 the chamfers 8 are illustrated extremely wide in respect to the widths of the floor panels 2. In reality, these chamfers 8, as measured horizontally, mostly have a width of less than 3 mm and even less than 2 mm and is the width in certain cases still considerably smaller than 2 mm.

In the represented example of FIG. 2, the floor panel consists of a laminate panel of the DPL type (Direct Pressure Laminate) and has a top layer, which is composed, in a known manner, of a decor layer 12 and an overlay 13. The decor layer 12 consists of a support sheet upon which the respective decor is printed and which is impregnated with a resin. The overlay 13 also consists of a support sheet immersed in resin. In this overlay 13 preferably substances, such as corundum, are integrated in order to enlarge the wear resistance of the surface of the floor panel. The decor layer 12 and overlay 13 are pressed onto an underlying substrate 14 consisting, for example, of MDF or HDF board.

In the represented example, the aforementioned chamfers 8 extend through the substrate 14, which, however, does not necessarily have to be so.

It is clear that the invention can also be used in combination with floor panels of another construction, wherein this may be both laminated floor panels and other floor panels. Also, the substrate 14 may consist of any suitable material and either can be composed of several parts or layers or not.

Figure 3:
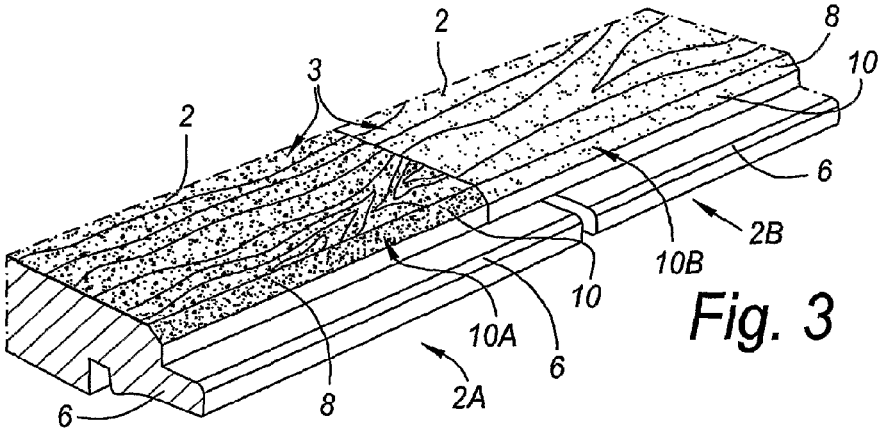
FIG. 3, at a larger scale and in perspective, represents a view according to arrow F3 in FIG. 1.

The particularity of the invention, at least for a first aspect, consists in that the appearance of the aforementioned decorative covering 10 is realized varying in function of differences occurring in said decor 3 of the floor covering 1. As can be seen in FIGS. 1 and 3, in the represented embodiment the chamfers 8 of the different panels 2A and 2B are provided with respective, mutually differing decorative coverings, which, for distinction purposes, are also indicated by 10A and 10B. More specifically, in the represented example the darker panels 2A are provided with a darker covering 10A on their chamfers 8, whereas the lighter-colored panels 2B have a light-colored covering 10B on their chamfers 8. In this manner, it is obtained that the global color or tint of the covering 10A can be adapted to, preferably can be brought into accordance with, the global color or tint of the upper side of the panel 2A, whereas the global color or tint of the covering 10B can be adapted to, preferably is brought into accordance with, the global color or tint of the upper side of the panel 2B.

The decorative layer 11 preferably consists of a print, and still better a print that is realized by means of a printer, more particularly by means of an inkjet printer or inkjet printer supply system, by printing directly onto the chamfer 8. This does not exclude that still other layers are present beneath the print.

Preferably even the decorative layer 11 is formed by a multicolor print.

Figure 4:
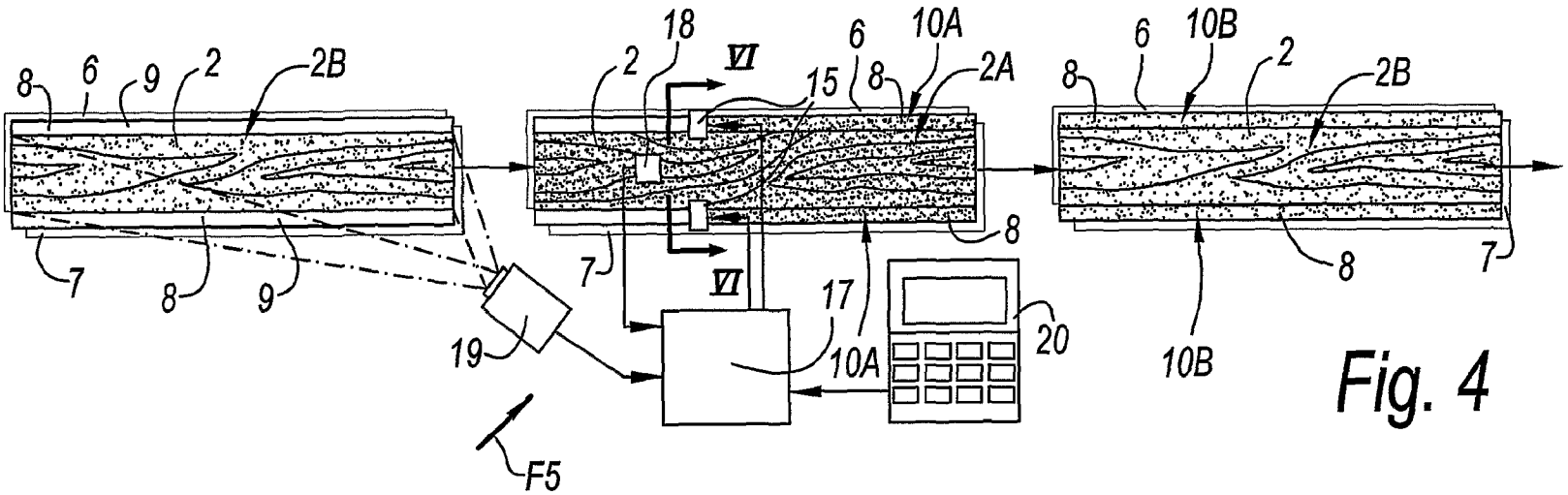
FIG. 4 schematically represents a step of a method for manufacturing the floor panels from which the floor covering from FIGS. 1 to 3 is composed.
Figure 5:
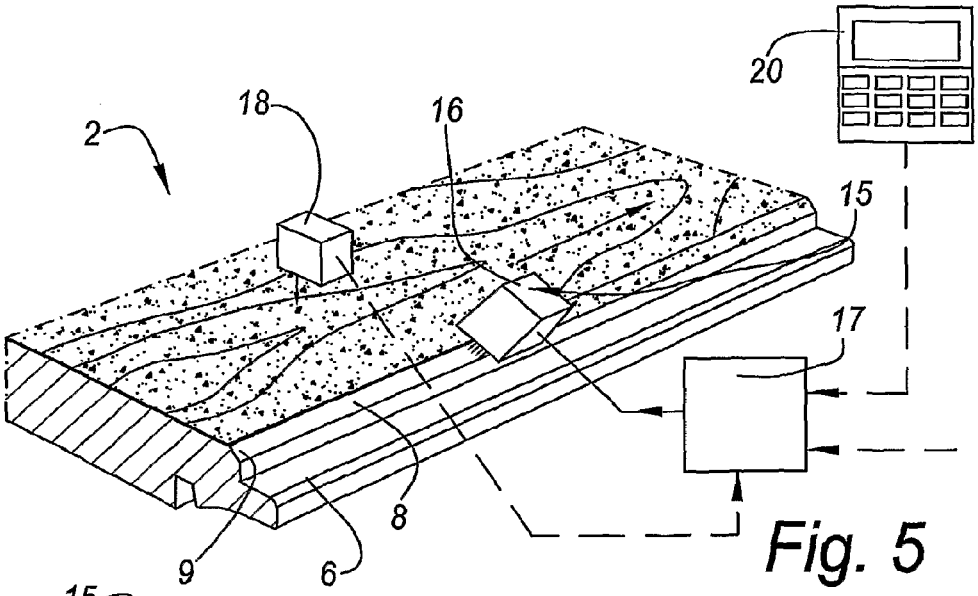
FIG. 5 schematically represents a perspective view according to arrow F5 in FIG. 4.
Figure 6:
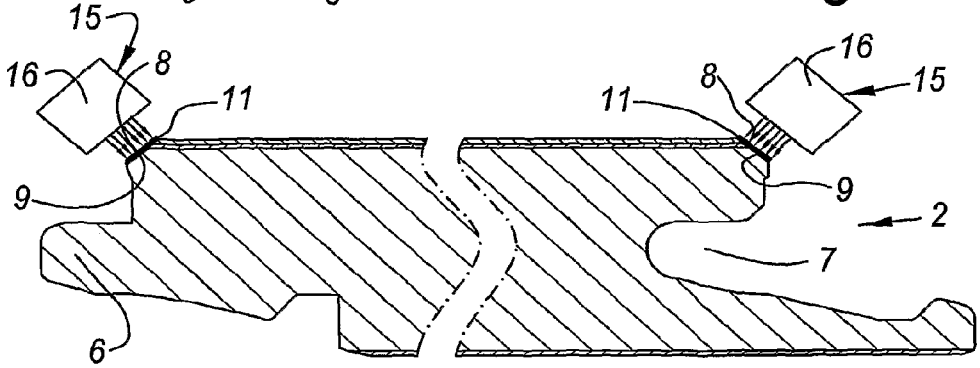
FIG. 6, at a larger scale, represents a cross-section according to line VI-VI in FIG. 4.

In FIGS. 4, 5 and 6 is illustrated how the floor panels 2 represented in FIGS. 1 to 3 can be provided with a suitable covering 10A or 10B on their chamfers 8. The technique represented herein also forms an example of the method presented according to the invention.

The particularity of this method consists in that the aforementioned covering 10, and more particularly 10A-10B, is formed at least of a decorative layer 11, which, by means of a controllable application system 15, is provided on the surface of the chamfer, wherein by means of the control of said application system 15 at least the appearance of the covering 10 formed therewith is controlled such that the appearance of the obtained decorative covering 10A-10B varies in function of differences occurring in the decor of the floor covering 1, the floor panels 2, respectively.

The applied application systems 15 can be of different kind, however, as schematically represented, preferably use is made of one or more printers 16, preferably digital printers operating according to the inkjet principle. In the example, the floor panels 2 are moved along two printers 16, which each provide for a print of a chamfer. Of course, use might also be made of a common printer extending transversely over the floor panels 2, which then is printing at least, however, preferably solely, at the locations of the chamfers.

The application systems 15 are controlled by means of a control unit 17, for example, a processor or the like.

When the control unit has been informed according to which sequence the floor panels 2A and 2B are supplied to the application systems 15, the control unit 17 can use this sequence for suitably controlling the application systems 15 and thereby provide a covering 10A, in this case, on the darker panels 2A, which is adapted to the general tint of the upper side of such panel 2A, whereas the covering 10B is made lighter-colored, thus, adapted to the general tint of the upper side of the panel 2B.

According to other possibilities, the control of the application systems 15 takes place in function of one or more detections that are performed on the respective floor panels.

So, for example, a panel recognition can be performed by means of a detector 18, for example, an optical eye or a camera, after which the control unit 17 suitably commands the application systems.

According to another possibility, use can be made of a detector 19, for example, a camera, which globally scans each floor panel to be treated and thereby, by means of the observed tint, can determine whether a floor panel 2A or 2B is concerned, after which the application system 15 then, at the moment when the respective floor panel is presented to these application systems, can be commanded in a suitable manner.

Still better, by means of a detector, which, for example, is the detector 18 or 19, the general tint of the decor 3 of a floor panel shall be determined and in function of this determination a print on the chamfer shall be performed, preferably then with the same tint.

The two application systems 15 located on opposite sides of the floor panels do not have to be commonly controlled and possibly may be commanded separately, for example, in function of separate detections. By means of an operation panel and/or reading unit 20, data can be put in and/or read out.

Figure 7:
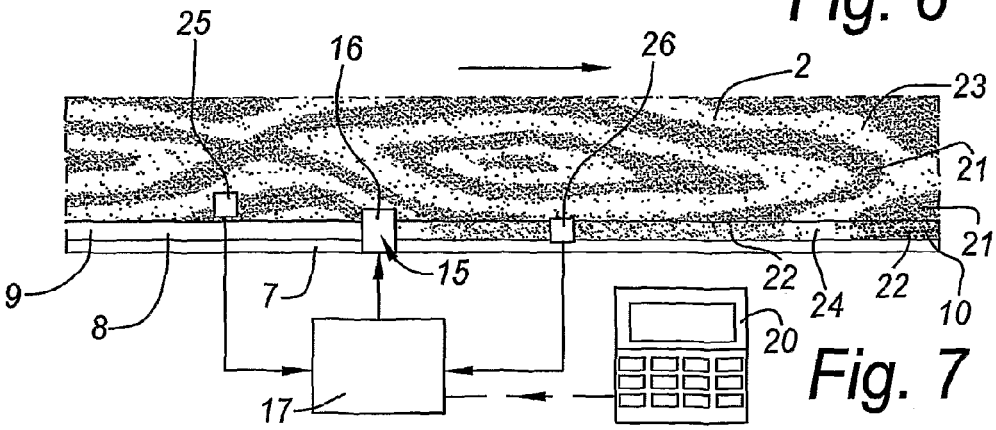
FIG. 7 represents a variation of the invention.

FIG. 7 schematically represents a portion of a floor panel 2, wherein the appearance of the decorative covering 10 is made in a varying manner in that this appearance, within the chamfer 8 of one and the same panel 2, is made differently, wherein the decorative covering 10 of such chamfer then is adapted to changes occurring within the decor of the respective panel 2 itself. Hereby is meant that over the length of one and the same chamfer 8, thus, of one and the same floor panel 2, variations occur in the covering 10 that are performed in function of the decor situated at the upper side. In the example of FIG. 7, the aforementioned decor has darker portions 21, whereas adjacently also adapted darker portions 22 are present in the covering 10. The same is valid for lighter-colored portions 23 in the decor and corresponding light-colored portions 24 in the covering 10.

In the embodiment of FIG. 7, the control of the application system 15, which system is formed, for example, also by a printer 16, takes place in function of a detection performed on the respective floor panel. More particularly, herein the control is performed by means of a forward coupling, wherein, for example, by means of a detector 25, a detection is performed on the top surface of the floor panel 2 in order to thereby determine features relating to the appearance thereof, after which these data are applied for realizing an adapted covering on the respective chamfer 8. Thus, in the example of FIG. 7 is determined by means of the detector 25, where dark and light-colored parts, 21 and 23, respectively, are situated at the height of the respective edge of the floor panel 2, in order to thereby realize the portions 22 and 24 in a corresponding manner.

By means of a detector 26, a control can be performed and possibly, by means of a feedback coupling, a correction can be realized. When the effectively printed color or tint deviates, at a well-defined place, from the color or tint that ought to be printed according to the detection by detector 25, this, by such feedback coupling, can be corrected for the print that still has to be performed. It is clear that for the respective control, the distance between the detectors 25-26 of the application system 15 must be taken into consideration.

Figure 8:
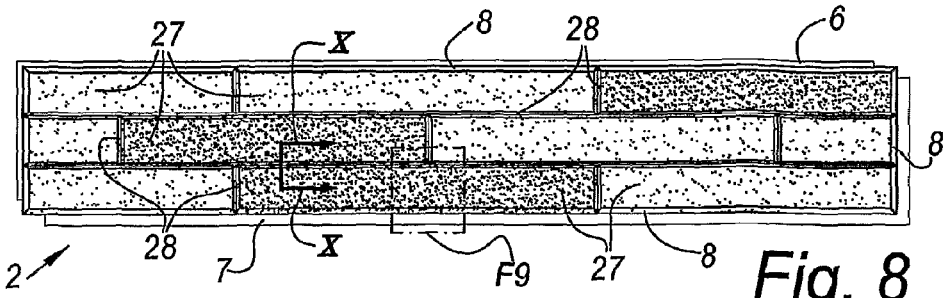
FIG. 8 represents a floor panel made according to the invention.
Figure 9:
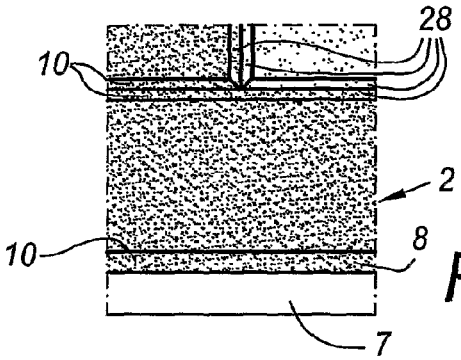
FIG. 9, at a larger scale, represents the portion indicated by F9 in FIG. 8.

FIGS. 8 and 9 represent another example, wherein the covering 10, in respect to its appearance, varies within one and the same floor panel 2. Here, this relates to a floor panel 2, for example, a laminate floor panel, with a pattern having several segments 27 each imitating a parquet plank, wherein a number of these segments 27, by way of example, have a differing color intensity or degree of darkness. At the floor panel 2, chamfers 8 and 28 are provided that have coverings 10, and more particularly decorative layers 11, which then vary in respect to appearance in function of the top surface of the adjacent segments 27.

Figure 10:
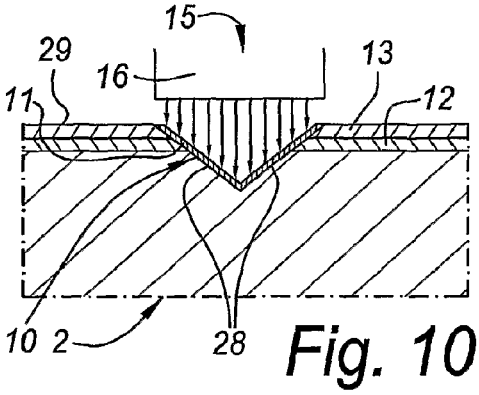
FIG. 10, at a larger scale, represents a cross-section according to line X-X in FIG. 8.

FIGS. 8 and 9, as well as the cross-section illustrated in FIG. 10, also illustrate that a "chamfer" according to the present invention can relate both to a chamfer 8 situated at an exterior edge of the respective floor panel 2, and to a chamfer 28 relating to an imitation chamfer consisting of a groove-shaped sunk portion situated in the upper surface 29 of the respective floor panel.

Such sunk portion for forming an imitation chamfer 28 may have been effected in any manner. According to FIG. 10, this sunk portion is formed by a material removal through the layers 12-13, whereas according to FIG. 11, this is realized by means of an impression in the laminate top layer formed, in this case, by the layers 12 and 13.

Figure 12:
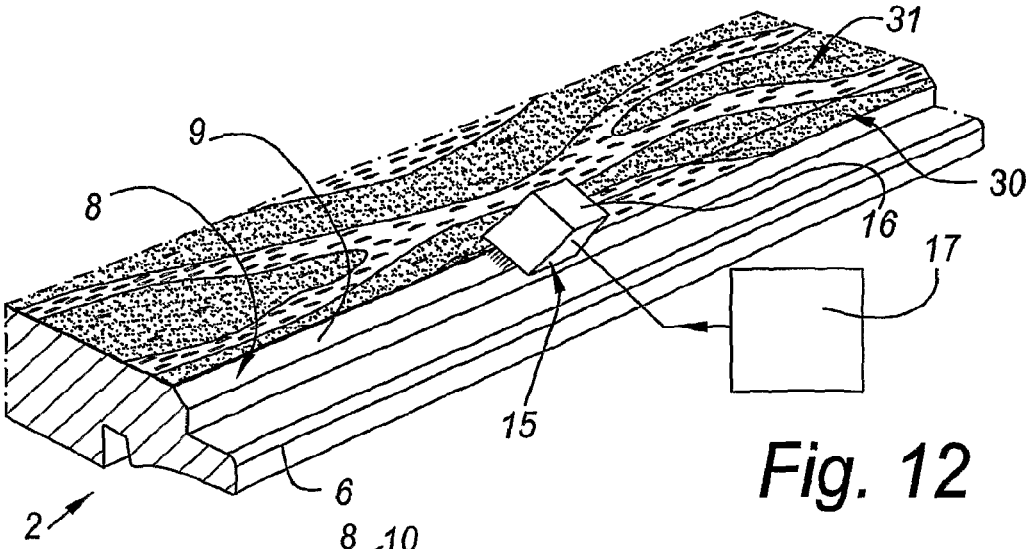
FIG. 12 represents another variant of the invention.

In FIG. 12, a variant is represented, wherein the covering on the chamfer 8 is not only provided with dark and light-colored portions, however, even is made in the form of a pattern 30, which is adapted to the pattern 31 situated at the upper side of the floor panel 2, or at least is adapted thereto up to a certain level. When it is known which pattern 31 the panel presented to the application system 15 is having, a corresponding pattern 30 can be printed according to stored data. According to variants, use might also be made of a control in function of the detected values, wherein then, for example, in function of the detection a corresponding pattern is printed, the suitable data of which are taken from a database in which different patterns are stored.

Figure 13:
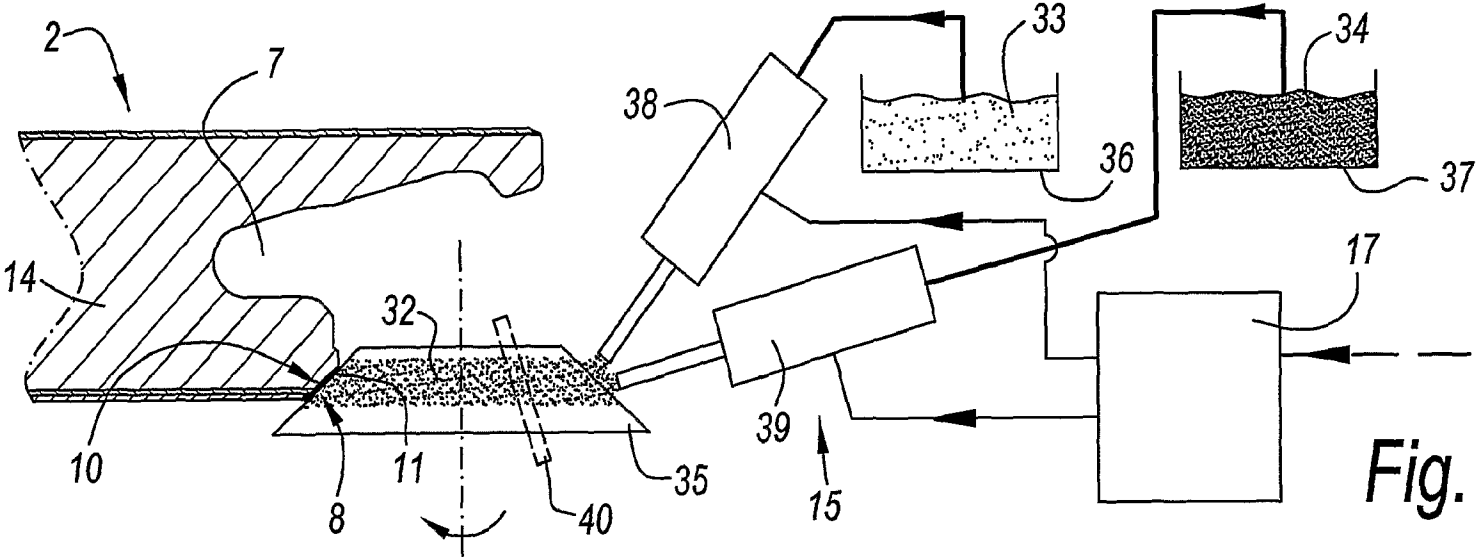
FIG. 13 represents a particular form of embodiment of the method according to the invention.

It is noted that a covering 10 varying in appearance according to the invention does not necessarily have to be applied by a printer 16 and that any other controllable supply system can be applied. As an example thereof, in FIG. 13 schematically a variant is represented, of which the covering 10, and more particularly the decorative layer 11, is formed by applying a coloring substance 32 on the surface of the chamfer 8, said substance consisting of a blend of two substances 33-34 differing in color or tint from one another.

The substances 32-33-34 may consist of a type of paint, such as colored lacquer or the like, however, other substances, for example, inks, are not excluded.

The substance 32 is applied by means of a roll 35 on the surface of the chamfer 8. The substances 33 and 34 are provided on the surface of the roll 35 from reservoirs 36-37 and controlled nozzles 38-39, where they blend to the substance 32, which is substantially uniform in respect to color. By altering the mixing ratio, the color can be altered and in this manner thus a covering 10 varying in appearance according to the invention can be realized. The control can be performed in a similar manner as described above, whether or not by means of signals originating from detectors. Possibly, the mixing ratio can be altered by means of a proportional control.

Alongside the roll 35, a stripper 40 or the like can be provided in order to dose the substance 32 or letting it through over only a well-determined width.

Other forms of mixing and application systems are not excluded. So, for example, the nozzles 38 and 39 might spray the substances 33 and 34 directly onto the chamfer 8. Also, only one nozzle might be applied, wherein the mixing of the substances 33 and 34 upstream of such nozzle takes place by means of a controlled mixing system. Instead of mixing the substances 33 and 34, one can also work with different substances, wherein alternately, in function of the desired effect, the one or the other substance is supplied to the chamfer.

According to a variant, also a transfer printing procedure could be applied, with two or more transfer tapes, wherein in function of the desired covering the one or the other transfer tape is pressed into contact with the respective chamfer.

Figure 14:
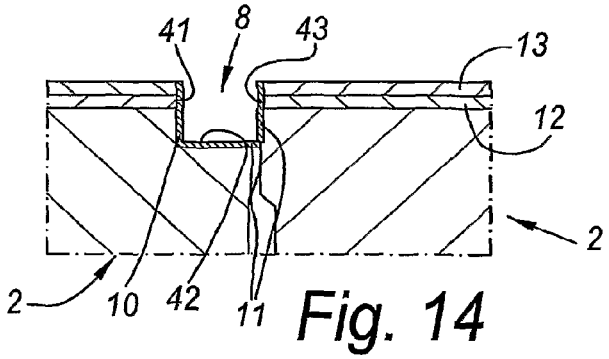
FIG. 14, at a larger scale, represents a variant of the portion indicated by F14 in FIG. 2.

FIG. 14 represents a particular form of chamfer 8, formed by a rectangular recess. The wall parts 41-42 and 43 are provided with coverings 10 formed by decorative layers 11, which then, according to the invention, are provided with a varying appearance.

Figure 15:
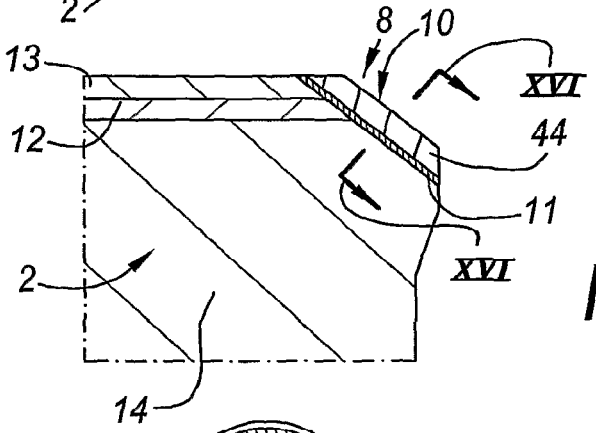
FIG. 15, at an enlarging scale, represents a particular form of embodiment of a chamfer according to the invention.

FIG. 15 shows a variant, wherein the aforementioned decorative covering 10 comprises at least one transparent, or anyhow at least partially transparent, covering layer 44, which is provided on top of the decorative layer 11. This layer forms a protection for the decorative layer 11. Moreover, as set forth in the introduction, it can bring about additional effects.

Figure 16:
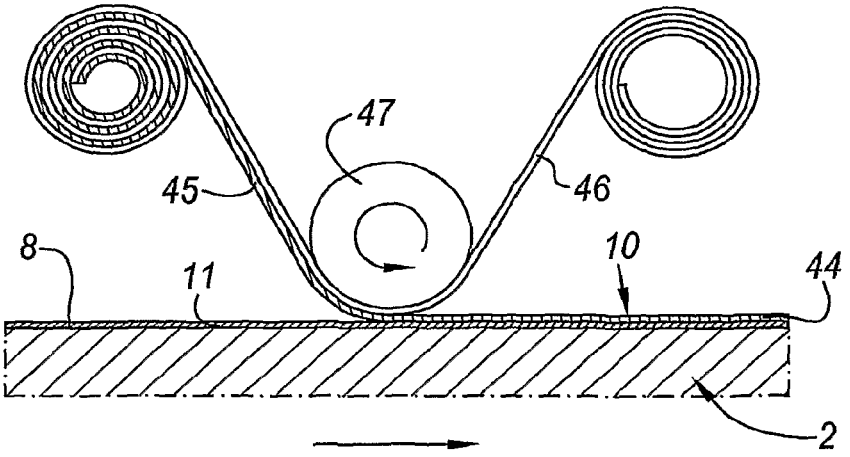
FIG. 16 schematically represents a technique for realizing the chamfer of FIG. 15.

As schematically represented in FIG. 16, the aforementioned covering layer 44 can be formed by a transparent or at least partially transparent substance 45 applied by means of transfer printing. Herein, this substance is supplied on a carrier tape 46 and, by applying pressure delivered, for example, by a pressing roller 47 or other pressing system, and possibly at an increased temperature, is transferred onto the decorative layer 11.

The covering layer can be realized in other ways, too, for example, in the form of a transparent lacquer or the like.

It is clear that the invention can be realized at a variety of chamfers at floor panels. With rectangular floor panels with chamfers at the four upper edges, it thus can be applied at both pairs of opposite sides, as well as at one pair thereof.

Laminate panels and the like mostly are made of larger panels, wherein the latter are cut, for example, sawed, to floor panels. It is not excluded to provide certain chamfers with a covering already before sawing, for example, in the case that imitation chamfers 28 are present in the board to be sawed.

It is noted that the variation of the decorative covering may relate to different features. As aforementioned, herein in particular a variation in color, tint or pattern must be thought of. According to an alternative, which possibly can be applied in combination with variations in color, tint and/or pattern, a variation of the gloss degree of the covering on the chamfer is provided for.

It is clear that, when printing on a chamfer, certain pre-treatments may be performed, such as extra smoothing of the surface, for example, in order to flatten projecting fibers, which in German is named "Glätten", applying a primer or primary coat, and so on.

It is also clear that the covering can be provided with a surface structure or, thus, a relief, which, when the covering represents a pattern, either is applied corresponding to this pattern or not.

According to a particular aspect of the invention, which either can be applied in combination with the aforegoing or not, the invention provides for a method for manufacturing a floor panel, wherein in the upper surface, an imitation chamfer is provided, such as, for example, the imitation chamfer 28 represented in FIGS. 8 to 11, with the characteristic that the surface of the imitation chamfer is provided with a covering and that the covering is applied by means of a printer, preferably a digitally controlled printer and/or a device working according to the inkjet supply principle. The use of a printer allows to provide such, otherwise difficult to reach, imitation chamfer 28 with a covering in a smooth manner. Moreover, in production in the same production line, one can switch to coverings with another appearance at any moment, at least when a multicolor printer is used, by controlling it in a suitable manner.

Figure 11:
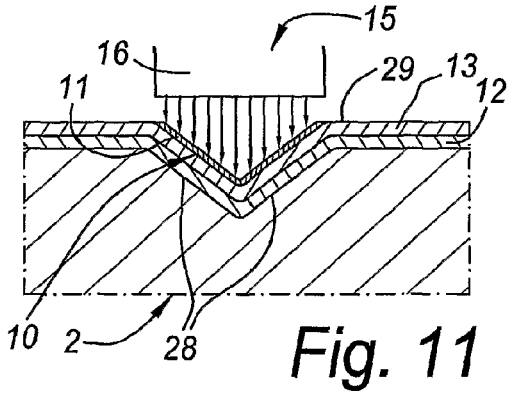
FIG. 11 represents a variant of the portion that is illustrated in FIG. 10.

This method is particularly useful when manufacturing laminate floor panels with a top layer on the basis of synthetic material, said top layer being composed of one or several layers, wherein the imitation chamfer 28 is formed by an impression, for example, as represented in FIG. 11. A first advantage consists in that for forming the groove, no separate milling treatment must be performed and that the impression simply can be realized during the pressing of the laminate. A second advantage consists in that, when different patterns are present at opposite sides of the groove, such as, for example, in FIG. 8, and the transition between the patterns is situated in the groove, however, not in the middle thereof, for example, due to stretching of the paper from which the laminate is made, this does not pose a problem as the faulty location of the transition then is printed over by means of the separately applied covering. In this case, such covering can be in contrast to the patterns, for example, can be performed as a black print, as well as be performed in the form of a pattern itself.

According to another particular aspect of the invention, which either can be applied in combination with the aforesaid or not, the invention provides for a method for manufacturing floor panels, wherein these floor panels are provided with a chamfer, for example, such as chamfer 8 or 28, and a covering 10 is provided on this chamfer, with as a characteristic that the covering is provided with a relief by making use of a transfer printing procedure, wherein the transferred substance shows a relief because it originates from a tape showing a relief in its turn. Hereby is meant that, for example, in FIG. 16, at the side of the carrier tape 46 against which the substance 45 is applied, a relief or thus a surface structure is present. The mirror image of this relief then is created in the upper side of the finally obtained covering. When a pattern is printed by means of the transfer printing, such relief either can be performed corresponding to the pattern or not.

Figure 17:
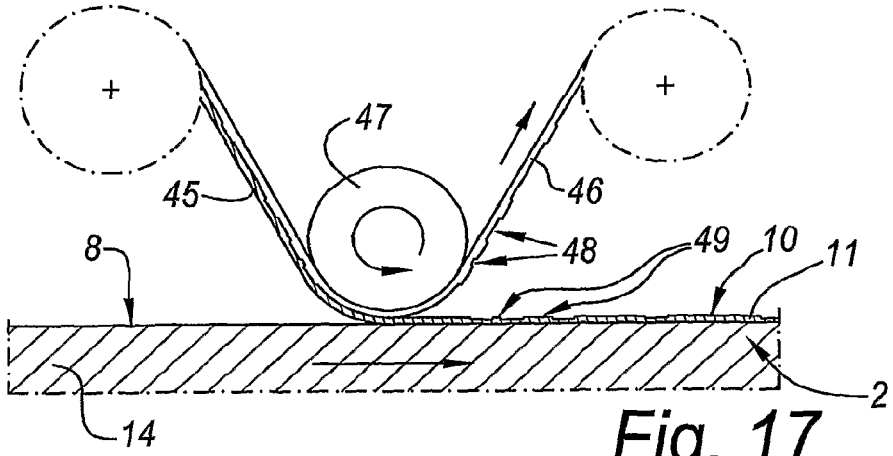
FIG. 17 schematically represents another particular technique of the invention.

When the aforementioned technique is to be applied with the embodiment according to FIG. 16, the obtained relief will be situated in the transparent covering layer 44 present on the chamfer. However, it is clear that this technique must not necessarily be performed in combination with a transparent covering layer. As schematically represented in FIG. 17, such relief, in the case that the decorative layer 11 itself is realized by means of a transfer printing procedure, may also be formed directly in this decorative layer. As represented, the carrier tape 46, upon which the non-transparent substance 45 for forming the decorative layer 11 is situated, then is provided with a relief 48, such that, after transferring the substance 45 onto the chamfer 8, a relief 49 is obtained that is a negative of the relief 48.

Applying in this manner a relief on the chamfer, either in the transparent covering layer 44, or in the decorative layer 11 itself, has the advantage that this may take place in one operation with the application of the respective substance 45, and thus no separate impressing process for forming a relief will be necessary.

According to another independent aspect, the invention also relates to a method for manufacturing a floor panel, which, at its decorative side, is provided with a chamfer with a profiled surface, characterized in that on the profiled surface, a decorative covering is provided by means of a transfer printing procedure, wherein the covering is transferred from a transfer tape onto the surface to be covered and wherein the transfer tape, together with the covering present thereon, is pressed against the surface by means of a likewise profiled pressing element, the latter showing a profiled pressing surface adapted to the shape of the profiled surface of the chamfer. By a profiled surface, in this case a surface is to be understood that is not flat but, for example, is curved, or that is composed of several flat parts at a differing angle.

Figure 18:
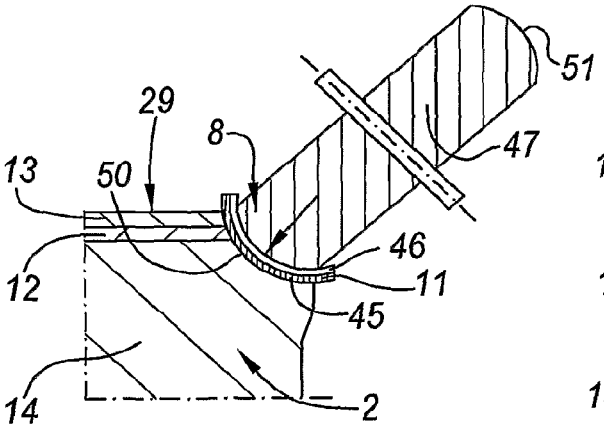
FIG. 18 represents another particular technique of the invention for applying a decorative covering on a chamfer.
Figure 19:
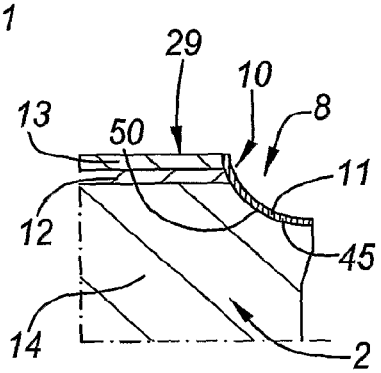
FIG. 19 represents the chamfer from FIG. 18 after the covering has been applied thereupon.

An example hereof, applied to a chamfer 8 at the edge of a floor panel 2, is represented in FIGS. 18 and 19. Herein, the chamfer 8 shows a surface 50 that is profiled as it has a hollow round shape. According to the aforementioned method, then use is made of a profiled pressure element, such as a pressure roller 47, having a profiled pressure surface 51 that is made corresponding or substantially corresponding to the shape of the surface 50, or wherein thus in this case the round shape of the pressure surface 51 shows the same curvature as the hollow round shape of the surface 50. When providing the decorative layer 11, then, as represented in FIG. 18, a pressing down over the entire surface can be guaranteed. FIG. 19 shows the chamfer 8 after the finishing thereof.

Figure 20:
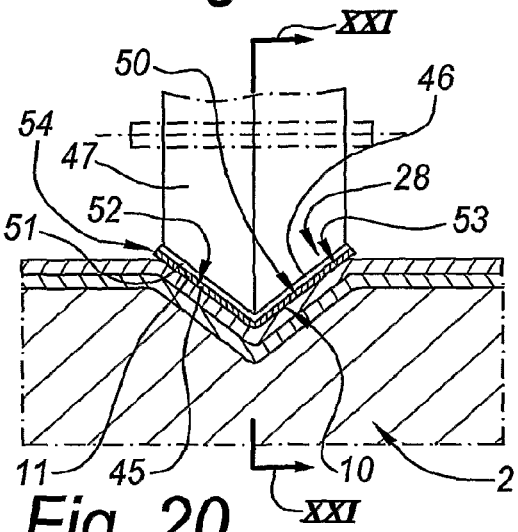
FIG. 20 represents a form of embodiment of a method according to the invention, wherein an imitation chamfer is provided with a decorative covering.
Figure 22:
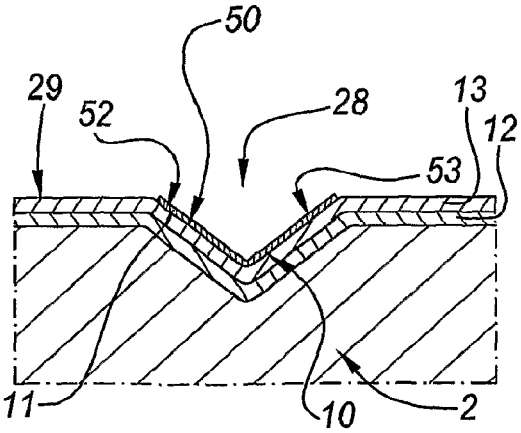
FIG. 22 represents the imitation chamfer from FIG. 20 after the decorative covering has been provided.
Figure 21:
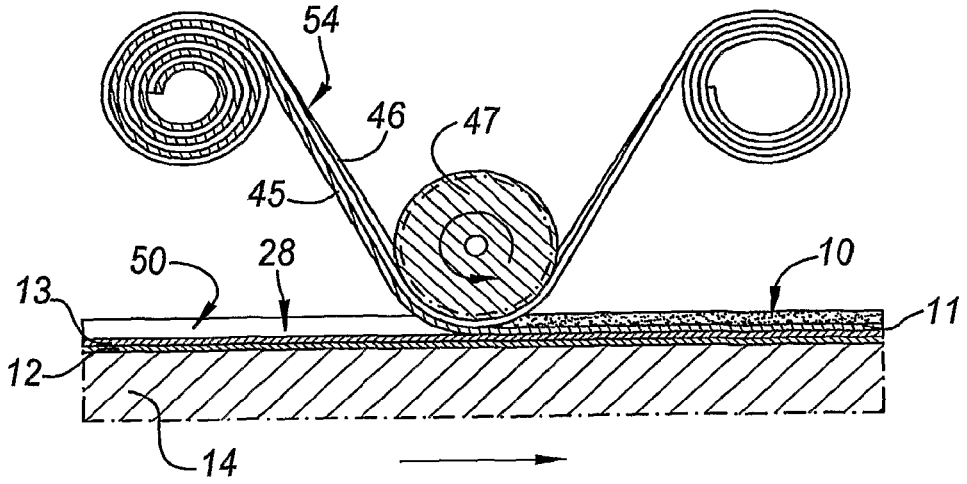
FIG. 21 represents a cross-section according to line XXI-XXI in FIG. 20.

FIGS. 20 to 21 show a variant, wherein the chamfer is an imitation chamfer 28 provided in the top surface 29, wherein the profiled surface 50 is formed by two opposite flanks 52-53 of this imitation chamfer 28 and wherein both flanks 52-53 are provided with a decorative covering 10, by means of a transfer printing procedure. As represented in FIGS. 21 and 22, a single common transfer tape 54 is applied for providing the decorative covering on both flanks 52-53. The particularity herein consists in that the transfer tape 54 consisting of the carrier tape 46 and the decorative substance 45 is forced into the shape of the surface 50 by means of a profiled pressure element, in this case, a pressure roller 47 with a V-shaped pressure surface 51.

The use of a profiled pressure element has the advantage that imitation chamfers 28 and chamfers 8 with a curved profile also can be printed smoothly by means of transfer printing.

The pressure element does not necessarily have to be a pressure roller. The pressure element may, for example, also consist of a pressure tape having in cross-section the suitable profile and further is, for example, installed and heated as described in WO 03/086779. The composition of the substances 45 as such is known from the state of the art or is simple to deduce from it.

It is clear that the invention also relates to floor panels that are realized according to any of the abovesaid or following methods.

According to another independent aspect, the invention also relates to a floor panel, of the type comprising at least a substrate, a decor and a top layer based on synthetic material, characterized in that the floor panel is provided with a chamfer on the upper side, more particularly with a beveled edge; that the top layer continues at the height of the chamfer and follows the shape of the chamfer; and that at the height of the chamfer, a separately applied decorative covering is provided over the aforementioned top layer. Herein, the decorative covering is made as a color or pattern. Amongst others, this technique has as an advantage that the top layer remains present and a better guarantee against penetration of moisture is given. Also, the appearance of the decorative covering on the chamfer can be chosen freely, irrespectively of the appearance of the decor, without having to remove the decor or, thus, the top layer at the height of the chamfer. Also, wide joints, such as cement joints, are simple to imitate. Contrary to cement joints printed into the decor, these are easier to realize at the right location, as joints realized in the decor often might shift due to strain in the decor layer.

Figure 23:
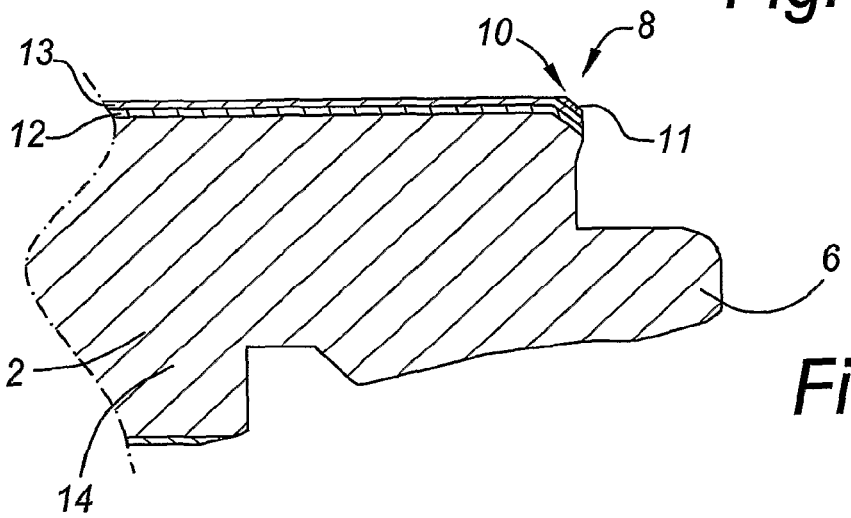
FIGS. 23 and 24 represent portions of two floor panels, respectively, which are made in accordance with a particular aspect of the invention.
Figure 24:
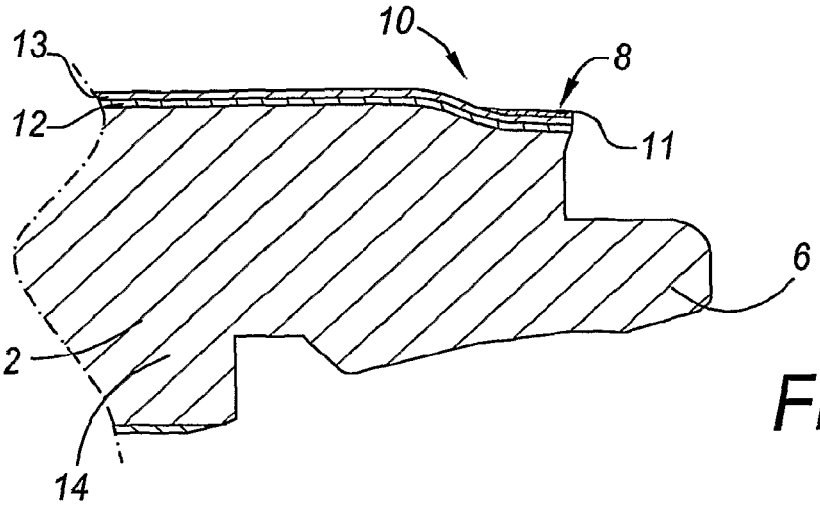

FIGS. 23 and 24 show examples of the aforegoing, applied to a chamfer 8 situated at the upper edge of the floor panel 2. The top layer, which is formed by the decor layer 12 and the overlay 13, continues integrally over the chamfer 8, and the decorative covering 10, at the height of the chamfer 8, is provided on top of the top layer.

FIG. 24 shows that the chamfer 8 does not necessarily have to be performed as a flat inclination, but may also have other shapes.

FIG. 24 also shows that the covering 10 does not necessarily have to be present over the entire chamfer 8.

The last-mentioned aspect of the invention may also be applied to an imitation chamfer. An example thereof has already been described by means of FIG. 11.

As aforementioned, the top layer preferably is formed of one or more resin-impregnated carrier sheets, whereas the decor consists of a print provided on such carrier sheet. The separately provided decorative covering preferably consists of a print, for example, a print by means of transfer printing.

The herein separately provided covering may also be provided in another manner than by means of printing.

As is evident in FIGS. 11, 23 and 24, the chamfer 8 or 28 preferably is formed by an impression, which is formed, for example, during the pressing of the laminate panels.

According to another independent aspect, the invention aims at a method for providing chamfers at a floor panel in an efficient manner with a separate decorative layer. To this end, the present invention also relates to a method for manufacturing a floor panel, wherein this floor panel comprises at least a substrate, a decor, as well as a top layer on the basis of synthetic material, wherein this floor panel is provided with a chamfer and wherein a separate decorative layer is provided on the surface of the chamfer, characterized in that the aforementioned decorative layer is provided on the surface of the chamfer by means of a digital multicolor printer.

The utilization of a digital multicolor printer offers the advantages that the decorative layer can be made in a variety of colors by means of a suitable control of the multicolor printer, that, if desired, a pattern can be represented in the decorative layer, that, if desired, the color or tint or the pattern, during application, can be made in a varying manner, and that during the production of the floor panels one can switch at all times almost immediately from one decorative layer to another, such that substantial switching times are excluded. This latter is very advantageous, in particular compared to the traditionally utilized techniques of transfer printing and the varnishing of the surface of a chamfer. In the known technique of transfer printing, when switching to another color or another pattern, transfer tapes must be exchanged, whereas, when applying lacquer, mostly the entire lacquer circuit of the machine applied therewith must be cleaned, which both are very time-consuming actions.

According to a particular form of embodiment of said method, the digital multicolor printer will be controlled automatically, either in function of production data, or in function of data derived from the respective floor panel. Deriving data from a floor panel may take place in various manners. One possibility is that the decor or a portion of the decor that is situated at the upper side of the panel, is scanned and in function thereof the color and/or tint and/or the pattern that is realized by the digital multicolor printer, is controlled. Another possibility consists in that a mark is provided on each floor panel, said mark being detected prior to the application of the print on the chamfer, wherein, in function of the detection, an appropriate control of the digital multicolor printer is performed. Such mark may be provided, for example, on the bottom side of the floor panels. The mark may be of different kind, however, a practical possibility is the use of a barcode. The necessary data for controlling the digital multicolor printer then can be derived from an automatic reading of the barcode. Possibly, the necessary data can be integrated into the traditional product codes, as it suffices to be able to derive from them which kind of decor is present at the upper side in order to determine, in function thereof, which decorative print must be realized on the chamfer.

Possibly, use can be made of a mark present in the decor, which mark, for example, has been included into the decor during printing thereof. In this manner, the risk of the floor panel having a wrong mark or, thus, wrong code, is minimized.

Herein, a mark may be applied that can not be seen with the naked eye, for example, a code printed into the decor that can only be scanned by means of UV light or the like.

Figure 25:
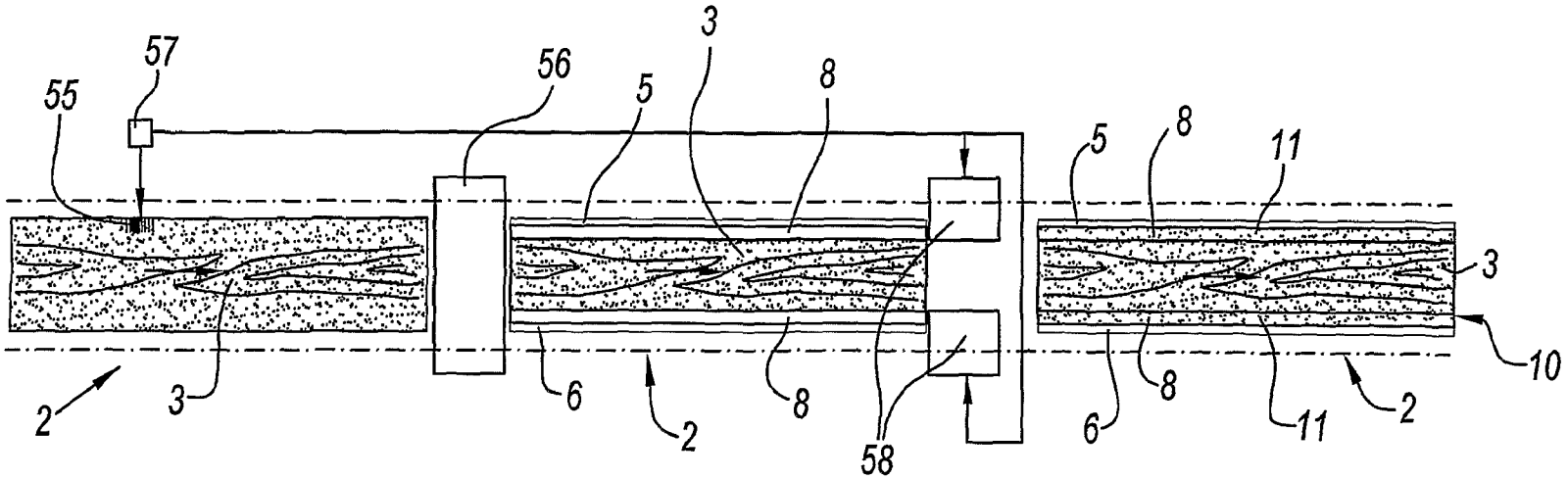
FIG. 25 represents another particular method of the invention.

Also, use can be made of a mark situated on a portion of the decor that is removed, more particularly cut away, when the coupling parts and/or chamfers at the respective panel are applied. This is illustrated in the schematic representation of FIG. 25. Herein, the supplied floor panels 2, which in fact still are semi-finished products, are provided with a mark in the edge region to be milled away, such as a barcode 55 comprising data related to the decor 3. Prior to milling the coupling parts 5-6 in the milling machine 56, the barcode 55 is scanned by means of a detector 57. After milling the coupling parts, wherein in the example also chamfers 8 are formed, the portion of the decor comprising the barcode 55 is milled away, as can be seen in the middlemost represented floor panel. The data collected by means of the detector 57 subsequently are applied for controlling the digital multicolor printers 58, such that a desired decorative layer 11 is printed onto the chamfers 8. It is clear that according to a variant, the chamfers also might be present at the floor panel 2 prior to milling, for example, in the case that they are formed of impressions that are already present in the aforementioned semi-finished product.

In a particular application, the aforementioned digital multicolor printer 58 will be utilized for applying, as aforementioned, a decorative layer at a chamfer, as well as be utilized for coloring, at floor panels having no chamfer at the edge, the lateral edge of the top layer that often shows as a light-colored line, and in this way mask such line. At the lateral edge, the top layer in fact is cut through, which, as known, often results in a disturbing whitish line. By applying another color, possibly black, at the location of this line, a less disturbing effect can be created. In this manner, no separate printers have to be installed to this end.

The fact that a digital multicolor printer 58 is applied, does not exclude that decorative layers are printed that consist of a single color.

The fact that a decorative layer is provided on the chamfer by means of a digital printer, does not mean that this layer has to cover the entire surface of the chamfer and has to determine the entire decorative appearance of the chamfer. So, for example, the decorative layer, which is to be applied by means of the digital printer, might consist exclusively of a representation of wood pores, which are provided on a colored ground layer already present on the chamfer.

For the aforementioned multicolor printer, preferably use is made of an inkjet printer or a device working according to an inkjet principle.

By the aforementioned characteristic, which states that "the aforementioned decorative layer is provided on the surface of the chamfer by means of a digital multicolor printer", is meant that the printing by means of the multicolor printer preferably takes place in-line, in other words, that the printing takes place while the floor panels are passing. Herein, printing may be performed directly on the chamfer itself or not.

Preferably, the application of the decorative layer on the chamfer indeed is performed directly, in other words, one prints directly onto the chamfer present at the floor panel. This does not exclude that this chamfer, before being printed by the multicolor printer, already has certain covering layers, such as a laminate layer extending over the chamfer, or such as an especially provided ground coat. Such ground coat may, for example, fulfill the function of a primer and can be of any kind. So, for example, may the ground coat consist of a lacquer, a layer already provided earlier by means of a digital printer, or a layer provided by means of transfer printing, for example, of monochrome color.

Figure 26:
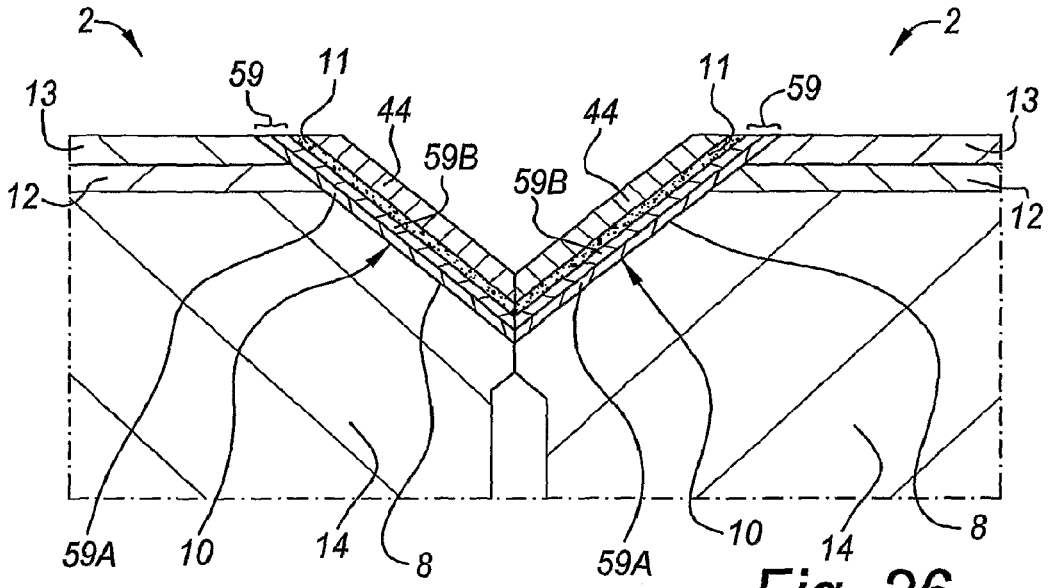
FIG. 26, in a view similar to that of FIG. 14, however, at a larger scale, represents another form of embodiment of a decorative covering on a chamfer.

FIG. 26 represents an example of the use of such ground coat 59 for a decorative layer 11. The ground coat 59 as such may or may not be composed of several layers. In the represented example, it consists of two layers 59A-59B, more particularly a layer 59A forming a flat base layer on the possibly raw surface of the chamfer 8, such as a layer of lacquer or the like, in combination with a primer or uniform print 59B provided on this flattening layer 59A. A ground coat 59 composed in this manner has the advantage that a better adherence of the primer 59B is obtained, which is particularly important with chamfers 8 of which the surface 9 is at least partially formed in the substrate 14, wherein this substrate 14 then comprises, for example, a material based on wood particles or wood fibers, such as MDF or HDF. It is noted that it is not excluded that said ground coat 59 solely consists of such flattening layer 59A.

The decorative layer 11 represented in FIG. 26 can be provided in any manner, however, preferably this relates to a decorative layer 11 applied by means of the method of the last-mentioned independent aspect, namely, by means of a multicolor printer 58. Then this decorative layer 11, as mentioned above and illustrated here, can be combined with a transparent covering layer 44, which latter can be realized in the above-mentioned ways. Preferably, the transparent covering layer 44 comprises a substance that is applied by means of a transfer printing procedure, for example, such as represented in FIG. 16, and/or a substance that has been applied in liquid form and subsequently hardened, such as a varnish or the like. For such hardening, depending on the kind of varnish, various methods are known. So, for example, may the hardening take place by the influence of heat or a variety of radiations, such as UV radiation or electron-beam radiation.

It is noted that the indirect in-line application of the print is not excluded. So, for example, might the print be performed by means of said digital multicolor printer onto a tape or other medium, which then subsequently is attached immediately on the respective chamfer, or wherein at least the print is transferred onto the chamfer by means of this tape or medium.

The indirect application by means of a printer in-line forms an independent aspect of the invention and thus is not limited to the use of a multicolor printer, in other words, other printers are also taken into consideration for this aspect.

Figure 27:
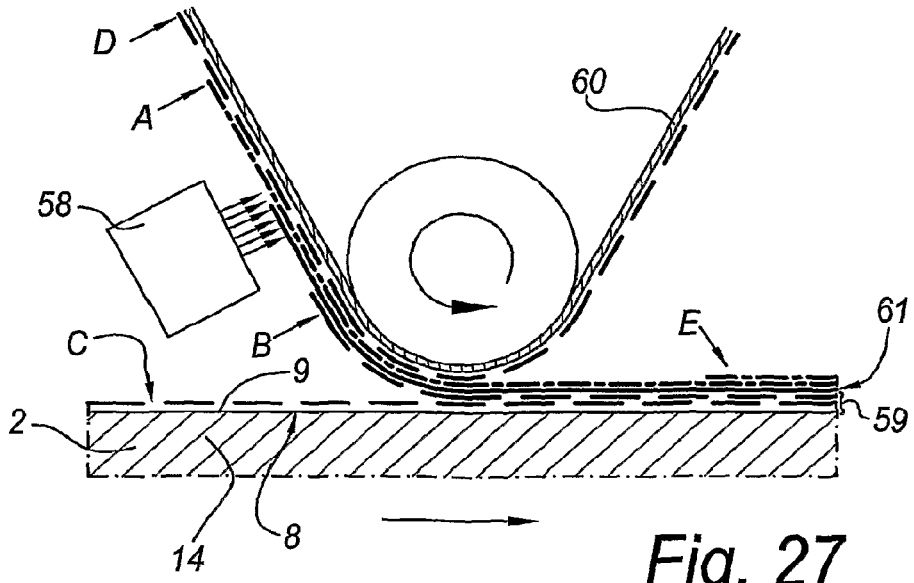
FIG. 27 schematically represents a method according to the invention for providing such decorative covering.

FIG. 27 schematically represents such method. Herein, by means of a printer 58, whether or not being able to print several colors, however, preferably being digital, a print 61 is performed directly or indirectly upon a transfer means, in this case a carrier tape 60, which then transfers this print 61 at least partially onto the surface 9 of a chamfer 8. The transferred portion of the print 61 forms on said surface 9 at least a portion of the decorative layer 11, which in its turn forms part of the decorative covering 10 of the chamfer 8.

Further, it is represented schematically in FIG. 27 that optional material layers of different types A-B-C-D-E can be applied separately or in any combination. Herein, each type is specifically characterized by the location where the respective material layer each time is supplied into the assembly. These material layers relate, amongst others, to layers with material that is or is not already present on the surface 9 of the chamfer 8 when the print 61 is transferred thereto, and/or with material that, whether or not by means of the aforementioned carrier tape 60 or possibly other carrier medium, is transferred simultaneously with the print 61 onto the aforementioned surface 9 of the chamfer 8.

The optional material layer of the type A relates to a material layer that is provided, in the direction of movement of the carrier tape 60 or other carrier medium, on said tape 60 or other carrier medium or is already present thereon before the print 61 is performed and is transferred onto the surface 9 of the chamfer 8 by means of said carrier tape 60 or similar together with the print 61. This optional material layer of the type A may relate, for example, to the aforementioned transparent top layer 44. As is clearly shown in FIG. 27, in this case the print 61 is performed on the bottom side of the provided material layer of type A.

The optional material layer of the type B relates to a material layer that is provided, in the direction of movement of the carrier tape 60 or possibly another carrier medium, on said tape 60 or on this medium, after the print 61 has been performed, and is transferred onto the surface 9 of the chamfer 8 together with the print 61. This optional material layer of the type B may relate, for example, to the aforementioned ground layer 59, or a part thereof, such as a flattening layer 59A or a primer 59B, and the optional material layer of type B may also comprise an adhesion agent that can accomplish the adhesion between an upper layer and the substrate 14 or a possible underlying layer.

The optional material layer of the type C relates to a material layer that is provided on the surface 9 of the chamfer 8 in the passage direction of the floor panel 2 or is already present thereon, before the print 61 is transferred onto this surface 9. This optional material layer of the type C may, for example, relate to the aforementioned ground layer 59, or a portion thereof, such as a flattening layer 59A or a primer 59B, and the optional material layer may also relate to an adhesion layer.

The optional material layer of the type D relates to a material layer that is provided on the tape 60 or said other carrier medium in the direction of movement of the carrier tape 60 or a possible other carrier medium, before the print 61 is performed and remains substantially present on the carrier tape 60 or the other carrier medium, after the print 61 has been transferred onto the chamfer 8. These optional material layer of the type D may relate, for example, to a layer that promotes the release of the material layers to be transferred, including the print 61, from the carrier tape 60 or a possible other carrier medium, in other words, a so-called "release layer".

The optional material layer of the type E relates to a material layer that is provided on the chamfer 8 in the passage direction of the floor panel 2, after the print 61 has already been transferred. This optional material layer of the type D may, for example, relate to the aforementioned transparent covering layer 44 and/or comprise abrasion-resistant material, such as hard particles of, for example, aluminum oxide or other ceramic material. It is evident that these examples are not restrictive and that the material layer of the type E may have various objectives and/or can be made in various ways. Another number of objectives are fixing the printed image, making the surface waterproof, rendering it antistatic, imparting a certain gloss degree, rendering it dirt-repellent and/or providing a substance that allows to create a relief in the final surface of the chamfer.

In the above, it is, of course, not excluded that the aforementioned optional material layers A-B-C-D-E in their turn are composed of several layers.

The carrier tape 60 can be of various nature. It can either be a tape describing a closed circuit, as well as a tape that is passed along once, for example, is rolled off and rolled up. With a closed circuit, this may, for example, be a driven endless tape that takes up and transfers the respective material layers. With a once passed tape, this may be made, for example, as a carrier tape of the type such as conventionally applied in known transfer procedures. As aforementioned, instead of the carrier tape also another carrier medium may be applied. Such other medium may be of any kind and consists, for example, of a pressure roller upon which the respective material layers are placed and subsequently are transferred.

Further, it is possible that the final decorative layer 11 situated on the surface 9 of the chamfer 8, instead of being applied entirely by the transferred portion of the print 61, is applied at least partially by means of the optional material layers of the types A-B-C or E.

Figure 28:
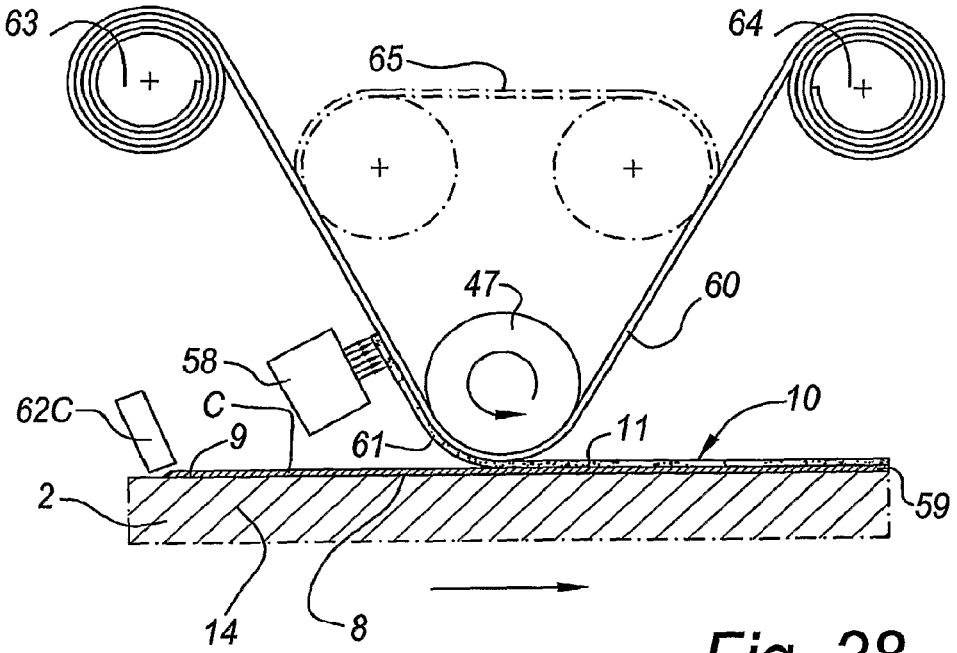
FIGS. 28 to 30 represent several practical examples of the method from FIG. 27.

FIG. 28 represents an example of a method according to FIG. 27, wherein a material layer of the type C is applied. This relates to the ground layer 59 that is already applied on the surface 9 of the chamfer 8 prior to transferring the print 61 onto the chamfer 8. In the example, a separate device 62C is provided to this aim.

Figure 29:
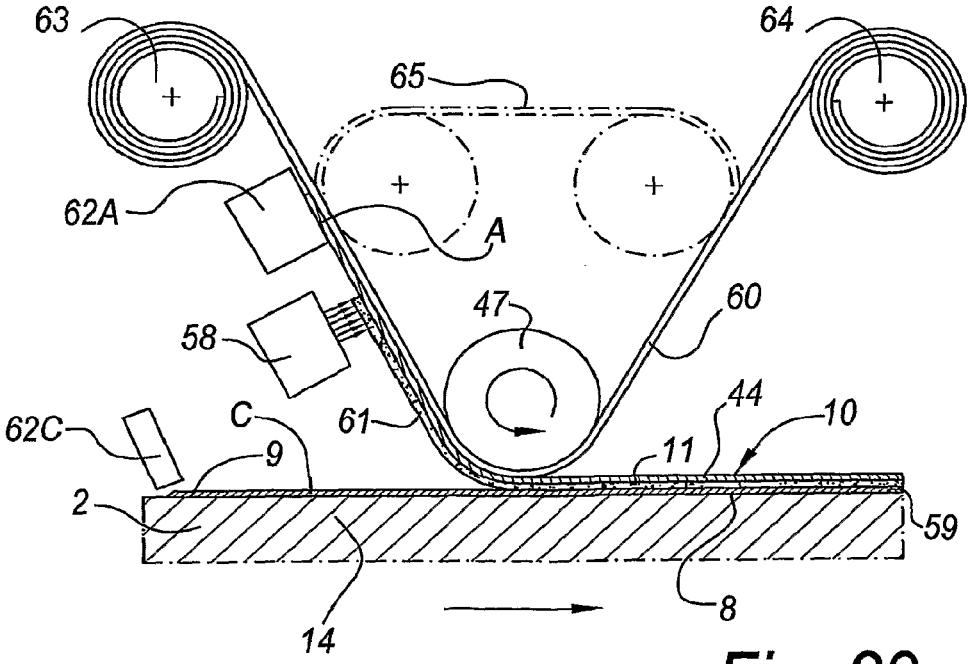

FIG. 29 represents another example, wherein in combination with the optional material layer of type C from FIG. 28, by means of the extra separate device 62A, a material layer of type A is applied. The material layer of type A relates in this example to the substance of the transparent covering layer 44.

Figure 30:
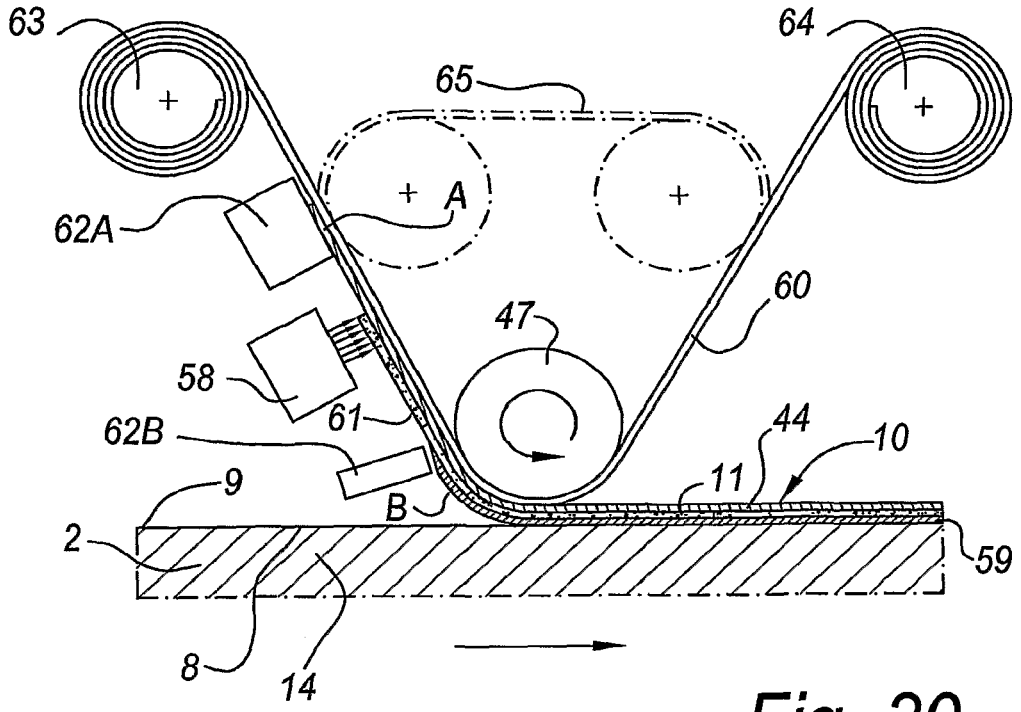

FIG. 30 represents an example of a method according to FIG. 27, whereby a material layer of type A as well as a material layer of type B are combined. The material layer of type A may relate to the same substance as in FIG. 29. In the example of FIG. 30, the material layer of type B is applied by means of the device 62B and comprises, for example, material forming a part of the ground layer 59, and/or, for example, a material functioning as an adhesion material.

It is noted that, when transferring the print 61 by means of the aforementioned carrier tape 60, preferably a certain pressure is applied and/or a certain amount of heat is supplied. More particularly, preferably the pressure and heat are applied that are typical in known transfer printing procedures.

It is evident that the carrier tape 60, the print 61 and the material layers of the types A to E do have to show suitable mutual affinities in order to accomplish the desired transfer. The choice of suitable materials for obtaining such affinity is within the knowledge of the person skilled in the art.

As represented in the examples of FIGS. 28 to 30, the carrier tape 60, as represented herein, can be supplied from a supply station 63 and directed towards a discharge station 64, where the carrier tape 60 possibly can be stored for recycling. As a variant, as is represented in FIGS. 28 to 30 in dashed line, also an endless carrier tape 60 can be used.

It is clear that the invention also relates to floor panels realized according to the aforementioned method and which thus possess at least one chamfer upon which a decorative layer is present, comprising at least a print that is a printout of a digital multicolor printer.

It is noted that, as already stated, independently of the fact whether a digital multicolor printer 58 is used, the idea of forming a print 61 in situ on a medium, for example, a carrier tape 60, and subsequently transferring this print 61 as a whole or partially in order to form at least a portion of a decorative layer 11 on a chamfer 8, as represented in FIGS. 27 to 30, also relates to an inventive idea of the present application. So, instead of a digital multicolor printer 58, also use can be made of other printing techniques, which preferably are digital, too. So, for example, may this inventive idea also be performed by means of one or more digital monochrome printers.

A further inventive idea and independent aspect of the present invention relates to the transfer of a digital print 61 onto the chamfer 8 of a floor panel 2, independent of the fact whether this print is formed in situ. To this aim, the present invention relates to a method for manufacturing floor panels 2, wherein this floor panel 2 comprises at least a substrate 14, a decor 3, as well as a top layer based on synthetic material, wherein this floor panel 2 is provided with a chamfer 8 and wherein, on the surface of the chamfer 8, a separate decorative layer 11 is provided by means of a transfer printing technique by means of a transfer film, with as a characteristic that said transfer film comprises a digital print 61, which is transferred by means of said transfer printing technique in order to form at least a portion of said separate decorative layer 11 on the surface of the chamfer 8. It is noted that such transfer film preferably has a printed width that is hardly larger than the surface of said chamfer. For the most-utilized applications, this width thus preferably will be kept smaller than five centimeters, and still better smaller than one centimeter.

Transfer films for applications on panels are known as such, for example, from U.S. Pat. No. 4,520,062. Up to now, such films, however, comprise prints that are obtained in a purely conventional manner, such as by means of offset printing or the like. Because of the extended change-over times, in order to work in an economical manner, it is for these conventional printing techniques mostly a necessity to produce large quantities of transfer film with the same print or pattern. With floor panels, for example, in the cases where a good adaptation of the decorative layer, which is obtained by transfer printing, on the chamfer to the decor of the floor panel is required, the minimal quantity for obtaining an economic production may exceed the demand. According to the present independent aspect of the invention, however, transfer films are applied with a print obtained by means of a digital printing technique. For the production of transfer films, such printing techniques can be applied in an economic manner even with small production quantities. This is of particular interest when only small surfaces must be covered with such film, as this is the case with the surface of a chamfer at a floor panel. As already stated, the width of this surface, measured in cross-section of the chamfer, for example, in the plane of FIG. 15, is less than 5 centimeters, and still better less than 1 centimeter.

It is noted that the present invention also relates to a transfer film that can be applied in a method for manufacturing floor panels, such as described above, with as a characteristic that the transfer film comprises a digital print, which, by means of said transfer printing technique, can be transferred in order to form at least a portion of said decorative layer on the surface of the chamfer. From the above, it is clear that such transfer film can offer major advantages for the production of, amongst others, laminate floor panels. Of course, here the same preferred width dimensions are valid.

Further, the invention also relates to a transfer film, more particularly for covering chamfers of floor panels, which comprises at least a carrier tape and a transferable print, wherein the carrier tape has a width of less than 5 centimeters, and still better of less than 1 centimeter, with as a characteristic that the aforementioned print is at least partially realized as a digital print.

From various aspects of the present invention, it becomes clear that a digital printer, whether a multicolor printer is concerned or not, offers the advantage that it is possible to provide a pattern on the surface of a chamfer in a simple manner. Moreover, a digital printer allows to switch to another pattern in a short time. In this respect, it is noted that the present invention also relates to a method for manufacturing floor panels, wherein this floor panel comprises at least a substrate, a decor, as well as a top layer based on synthetic material, wherein this floor panel is provided with a chamfer 8-28 and wherein a decorative layer 11 is provided on the surface of the chamfer, said layer 11 showing a pattern, with as a characteristic that the aforementioned pattern is at least partially directly or indirectly provided by means of a digital printer. The aforementioned pattern may be a visually to observe pattern having any desired form and may consist, for example, of a wood structure, for example, wood pores. The pattern can be provided on a ground layer 59 forming also a part of the decorative layer 11 and being, for example, of a uniform color. This ground layer 59 can be realized according to the techniques for applying such layers, described above in relation to other aspects of the invention. Of course, it is not excluded that the ground layer, too, has a pattern and possibly minor color variations.

It is clear that the invention also relates to floor panels that are obtained according to the aforementioned method, in other words, floor panels that are characterized in that they comprise a digital print in the form of a pattern on their chamfer.

It is noted that the aforementioned method, wherein a floor panel is provided with a mark and this mark is used to control the digital multicolor printer, is also advantageous for any other controllable application system for a decorative layer 11. In respect to the application of such marks, the invention, according to a variant, thus is not limited to the application thereof with digital multicolor printers, but to the same extent relates to applications wherein such marks are applied in combination with any controllable application system. Such marks can also be applied for controlling, in the first aspect of the invention, the aforementioned application systems 15. Herein, floor panels of the same global decor, however, with a different appearance, can be provided with different marks, wherein the application systems 15 then are commanded in function of the detected mark.

The present invention is in no way limited to the forms of embodiment described as an example and represented in the figures, however, such floor covering, floor panels and methods for manufacturing floor panels can be realized according to various variants without leaving the scope of the invention.

So, for example, do the aforementioned variations not have to be limited to two colors or tints and is it possible to work with more than two colors or tints.

It is also clear that all above-described independent aspects of the invention can be randomly combined inasmuch as the respective features are not contradictory.

Also, it is clear that the term "decorative layer" must be interpreted as a broad term. Such decorative layer does not necessarily have to be a material layer lying on top of the chamfer. For example, it may also be an ink or similar, which, after the application thereof, penetrates into the actual material of the floor panel and thereby provides the chamfer with a color and/or pattern, without being substantially present on top of the surface of the chamfer.

Where above a multicolor printer was mentioned, it is noted that, within the scope of the present invention according to all its aspects, it is not excluded that a plurality of printers may be applied, which in their turn possibly are monochrome, however, cooperate in such a manner that a multicolor print is created. However, preferably at least one digital device is applied that is able to print several colors.

In all above-described possibilities, wherein the decorative layer is realized by means of a printer, more particularly a digital printer, a transparent covering layer may be applied on top of said layer, and such in any manner.

The invention claimed is:

1. A method for manufacturing a floor panel, wherein the floor panel comprises at least a substrate, and a synthetic material based top layer, present at an upper side of the floor panel, said top layer comprising a decor;

wherein the floor panel, at least at two opposite sides or edges of the floor panel, is provided with coupling parts allowing that two of such floor panels can cooperate with each other at said sides or edges;

wherein said upper side of the floor panel, at least at one of said sides or edges, is provided with a chamfer; and wherein the method comprises at least the step of providing the surface of the chamfer with a separate decorative layer, the decorative layer being provided directly on the surface of the chamfer by means of a digital multicolor printer.

2. The method of claim 1, wherein the decorative layer is provided with a pattern by means of a suitable control of the digital multicolor printer.

3. The method of claim 1, wherein, for the digital multicolor printer, use is made of an inkjet printer or a device working according to an inkjet principle.

4. The method of claim 1, wherein the digital multicolor printer is automatically controlled in function of data derived from the floor panel.

5. The method of claim 4, wherein said data are derived from a mark that is present on the floor panel.

6. The method of claim 5, wherein said mark is present in the décor of the floor panel.

7. The method of claim 1, wherein said chamfer, before being printed by the digital multicolor printer, already is provided with a ground coat.

8. The method of claim 7, wherein said ground coat comprises a lacquer, or a layer already provided earlier by means of a digital printer, or a layer provided by means of transfer printing.

9. The method of claim 1, wherein said chamfer extends through the substrate.

10. The method of claim 1, wherein said chamfer, as measured horizontally, has a width of less than 3 mm.

11. The method of claim 1, wherein said decorative layer is thinner than the top layer of the floor panel.

12. The method of claim 1, wherein a transparent covering layer is applied on top of said decorative layer.

13. The method of claim 1, wherein said floor panel is a laminate floor panel.

14. The method of claim 13, wherein the floor panel is of the DPL (Direct Pressure Laminate) type.

15. The method of claim 13, wherein said top layer is composed of a décor layer, defining said decor, and an overlay.

16. The method of claim 15, wherein said décor layer consists of a support sheet upon which the décor is printed and which is impregnated with resin;

and wherein said overlay consists of a support sheet immersed in resin.

17. The method of claim 16, wherein corundum is integrated in said overlay.

18. The method of claim 17, wherein said décor layer and said overlay are pressed onto said substrate.

19. The method of claim 1, wherein said substrate consists of MDF or HDF board.

20. A method for manufacturing a floor panel, wherein the floor panel comprises at least a substrate, and a synthetic material based top layer, present at an upper side of the floor panel, said top layer comprising a décor;

wherein the floor panel, at least at two opposite sides or edges of the floor panel, is provided with coupling parts allowing that two of such floor panels can cooperate with each other at said sides or edges;

wherein said upper side of the floor panel, at least at one of said sides or edges, is provided with a chamfer;

wherein the method comprises at least the step of providing the surface of the chamfer with a separate decorative layer, said decorative layer showing a pattern, said pattern being applied at least partially directly or indirectly by means of a digital printer, wherein, in case said pattern is applied at least partially indirectly by means of said digital printer, a print is performed by means of said digital printer upon a carrier medium, said print being transferred from the carrier medium onto the surface of the chamfer in order to form at least partially said pattern, and wherein the digital printer is an inkjet printer or a device working according to an inkjet principle.

21. The method of claim 20, wherein said pattern consists of a wood structure.

22. The method of claim 21, wherein said wood structure comprises wood pores.

23. The method of claim 20, wherein said pattern is provided on a ground layer forming a part of the decorative layer.

24. The method of claim 20, wherein said chamfer extends through the substrate.

25. The method of claim 20, wherein said chamfer, as measured horizontally, has a width of less than 3 mm.

26. The method of claim 20, wherein said decorative layer is thinner than the top layer of the floor panel.

27. The method of claim 20, wherein a transparent covering layer is applied on top of said decorative layer.

28. The method of claim 20, wherein said floor panel is a laminate floor panel.

29. The method of claim 28, wherein said floor panel is of the DPL (Direct Pressure Laminate) type.

30. The method of claim 28, wherein said top layer is composed of a décor layer, defining said decor, and an overlay.

31. The method of claim 30, wherein said décor layer consists of a support sheet upon which the respective décor is printed and which is impregnated with resin; and wherein said overlay also consists of a support sheet immersed in resin.

32. The method of claim 31, wherein corundum is integrated in said overlay.

33. The method of claim 32, wherein said décor layer and said overlay are pressed onto said substrate.

34. The method of claim 20, wherein said substrate consists of MDF or HDF board.

* * * * *